US005722210A

United States Patent [19]

Baker et al.

[11] Patent Number: 5,722,210

[45] Date of Patent: Mar. 3, 1998

[54] MODULARIZED TRUSS

[75] Inventors: Michael J. Baker; Steven P. Boyenger; Joseph A. Fyie; Peter T. Mellblom; Christopher B. Meyer; Glen D. Robak; Michael D. St. John; Donald J. Sharp; Janice H. Zahn, all of Boise, Id.

[73] Assignee: Trus Joist MacMillan, a Limited Partnership, Boise, Id.

[21] Appl. No.: 580,635

[22] Filed: Dec. 28, 1995

[51] Int. Cl.[6] ..... E04B 1/32

[52] U.S. Cl. ..... 52/643; 52/639

[58] Field of Search ..... 52/639–643, 693, 52/695, 730.7

[56] References Cited

U.S. PATENT DOCUMENTS

| | | | |
|---|---|---|---|
| 1,011,245 | 12/1911 | Rafter | 403/260 X |
| 1,441,927 | 1/1923 | Heusinkveld | 52/639 |
| 2,604,060 | 7/1952 | Hansen . | |
| 3,193,973 | 7/1965 | Lee et al. | 52/639 |
| 3,457,689 | 7/1969 | Troutner | 52/639 |
| 4,261,665 | 4/1981 | Hsiung | 403/260 X |
| 4,393,637 | 7/1983 | Mosier | 52/640 X |
| 4,437,273 | 3/1984 | Helfman . | |
| 5,094,059 | 3/1992 | Ganescu . | |
| 5,365,705 | 11/1994 | Crowley et al. . | |
| 5,438,811 | 8/1995 | Goya | 403/237 X |

OTHER PUBLICATIONS

Brochure—Creative Industrial Solutions—Trus Joist MacMillan Mar. 1994.

Brochure—The Times Have Changed—Trus Joist MacMillan Oct. 1994.

Brochure—Total Support–Trus Joist MacMillan Nov. 1992.

Brochure—Step up to the Plate–Trus Joist MacMillan Oct. 1994.

Brochure—Creative Industrial Solutions—Trus Joist MacMillan Oct. 1992.

Brochure—MiTek Industires, Inc.—1992.

Brochure—A Guide to Wood Trusses—MiTek 1995.

National Design Specification for Wood Construction—1991.

Standard Specification for Evaluation of Structural Composite Lumber Products.

*Primary Examiner*—Carl D. Friedman

*Assistant Examiner*—Beth A. Aubrey

*Attorney, Agent, or Firm*—Kolisch, Hartwell, Dickinson, McCormack & Heuser

[57] ABSTRACT

A generally triangular truss, comprising a horizontal chord and a pair of inclined chords. The inclined chords are joined at an apex, and the horizontal chord extends between the inclined chords to form a base of the generally triangular truss. A pair of vertical ties extends between the inclined chords and the horizontal chord, and a horizontal tie extends between the two inclined chords. The chords and ties define therebetween a space in which to construct a living area. The joints between the chords and ties are defined by holes extending through the chords and ties, with the pins extending through adjacent ones of the holes to create pinned joints.

34 Claims, 6 Drawing Sheets

10
12
14
16
48
74
110
144
166/168
166/170
166/172

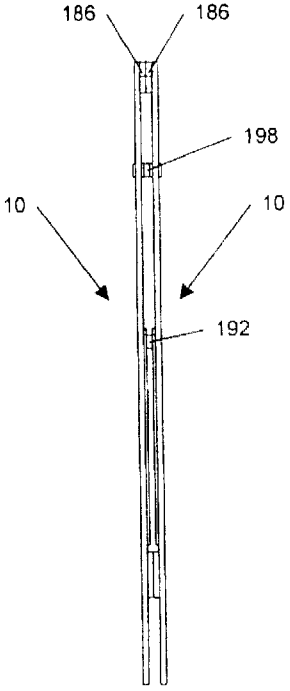
FIG. 28
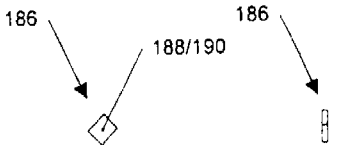
FIG. 19
FIG. 20
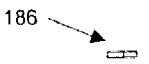
FIG. 21
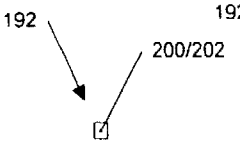
FIG. 22
FIG. 23
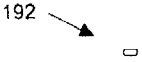
FIG. 24
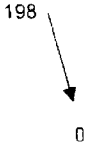
FIG. 26
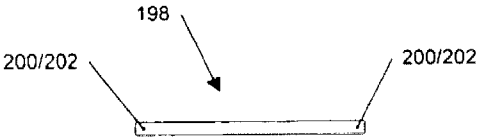
FIG. 25
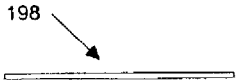
FIG. 27

MODULARIZED TRUSS

FIELD OF THE INVENTION

This invention relates generally to a truss for residential construction.

BACKGROUND OF THE INVENTION

Trusses are part of the structural framework for supporting a roof on a building. For the purposes of this disclosure, a truss is the generally planar frame that is normally combined with several other identical such frames to create a finished structure. In residential construction, the top element of each truss is called a rafter, top chord or inclined chord, and the bottom element is called a joist, bottom chord or horizontal chord. These chords are connected at about their ends by joints to define the outer shape and dimensions of the truss.

The chords are normally reinforced by other elements, referred to as stringers, webs or ties, that extend at a substantial angle to the chords to interconnect intermediate portions of one chord to one of the other chords, and/or one of the joints between the chords. If the tie connects to an intermediate portion of another chord, this transfers axial loads via chord deformation from the first chord to the second chord, resulting in additional forces on the second chord. Alternatively, if the tie connects to a joint between the chords or a joint between a chord and tie, the forces are transferred generally as tension or compression of the chords or ties at the joint.

The structural aim of a truss is to provide a framework that will carry a given load with the least amount of material. This reduces the material cost and increases the effectiveness of carrying that load. It is generally accomplished by limiting unnecessary bending forces in the elements of the truss. The vertical loads include the weight of the structure and items placed on the structure, and the horizontal loads include wind and seismic forces. It is important to keep the elements of the truss in a single vertical plane, and thus coplanar, if practical, to avoid placing eccentric loads on the joints between the elements.

To keep the truss in a single plane, the chords and ties are traditionally assembled with abutting joints, as opposed to overlapping joints. Abutting joints are normally either toenailed or plated with nail plates or press-plates that overlap adjacent portions of the interconnected members. Toenailed joints are structurally inferior, and the angle of penetration required for the nails often causes the wood to split. Plated joints are structurally sound in most materials, providing a semi-rigid joint through which both axial and bending forces are transferred. Abutting joints also require that each chord or tie have its ends cut to fit precisely within the adjacent elements.

While it is possible to cut elements to fit and to install press-plates on a job site, or to build the structure using overlapped nailed joints, pre-manufactured press-plated trusses are now generally preferred. These press-plated trusses are manufactured in a factory setting, where each element can be cut precisely and the press-plates can be installed precisely to ensure proper placement and structural interconnection of the truss elements. Through quality control of both the selecting of lumber for use in the truss, and the cutting and placing of the joints, highly consistent, structurally engineered trusses can be produced in factory settings. The pre-manufactured trusses are then delivered to the job site by truck, and are lifted into place by a crane, fork lift or other machinery. This results in a consistently constructed building, but may require a lot of heavy machinery for transporting and placing each truss.

Various manmade lumber materials, known as engineered lumber, have been developed over the years in an attempt to decrease dependence on old growth forests, to increase utilization of the raw materials from any given harvest, and to improve the consistency and structural properties of the lumber produced. The term "engineered lumber" as used herein is intended to encompass materials comprising wood fiber, adhesives and other fibers or filler, natural or manmade, organic or inorganic. Examples of engineered lumber include laminated strand lumber (LSL), laminated veneer lumber (LVL), parallel strand lumber (PSL), glued laminated timber (GLT), plywood, oriented strand board (OSB), particleboard and waferboard. A subset of engineered lumber is structural composite lumber (SCL), including LSL, LVL, PSL and GLT, as well as yet-to-be-developed materials. The term "structural composite lumber" as used herein is intended to encompass engineered lumber in which the direction of the grain of the wood elements and fibers is selectively aligned.

SUMMARY OF THE INVENTION

The present invention includes a new truss design and a new method of making trusses. These designs and methods have been found to work very well with engineered lumber, and more specifically with structural composite lumber. The invented truss is designed for use in residential construction, primarily in attics that are or can be finished to create living and storage spaces, and that span large spaces such as garages or open living rooms. Thus, the truss is designed to provide as much floor area in the living space as possible, while still providing workable headroom in the center of the living space and a clear span underneath the floor. The truss also provides uninterrupted storage space along the outer walls of the created living space. The truss has application to nonresidential construction as well, such as agricultural buildings, storage sheds, or animal shelters.

The truss is modularized in that it includes several prefabricated elements that are assembled on-site to create a truss of a defined shape with specifically placed joints connecting selected elements. The joints connecting the elements are defined by holes extending through the elements, with a pin extending through each of the holes to create a pinned joint which has pivot capability built into it. By comparison, typical roof framing uses either nailed rafters or press-plated trusses, as discussed above, with semi-rigid joints. Pinned joints also provide the above-discussed modularity, with many advantages as discussed below.

The truss is a generally triangular truss that includes a horizontal chord and a pair of inclined chords, the inclined chords being joined at an apex, and the horizontal chord extending between the inclined chords to form a base of the generally triangular truss. A pair of vertical ties extend between the inclined chords and the horizontal chord, and a horizontal tie extends between the two inclined chords. The chords and ties define a space in which to construct a living or storage area.

BRIEF DESCRIPTION OF THE DRAWINGS

FIG. 19 is a front elevation of a ridge spacer used to assemble two trusses into a double truss, shown on about the same scale as in FIG. 1;

FIG. 20 is a right side elevation of the ridge spacer shown in FIG. 19, shown on about the same scale as in FIG. 19;

FIG. 21 is a top plan view of the ridge spacer shown in FIG. 19, shown on about the same scale as in FIG. 19;

FIG. 22 is a front elevation of a vertical spacer used to assemble two trusses into a double truss, shown on about the same scale as in FIG. 19;

FIG. 23 is a right side elevation of the vertical spacer shown in FIG. 22, shown on about the same scale as in FIG. 22;

FIG. 24 is a top plan view of the vertical spacer shown in FIG. 22, shown on about the same scale as in FIG. 22;

FIG. 25 is a front elevation of a collar spacer used to assemble two trusses into a double truss, shown on about the same scale as in FIG. 19;

FIG. 26 is a right side elevation of the collar spacer shown in FIG. 25, shown on about the same scale as in FIG. 25;

FIG. 27 is a top plan view of the collar spacer shown in FIG. 25, shown on about the same scale as in FIG. 25;

FIG. 28 is a right side elevation of a double truss, shown on about the same scale as in FIG. 1;

DETAILED DESCRIPTION OF THE PREFERRED EMBODIMENT

Referring to FIGS. 1–5, the preferred embodiment is shown generally at 10, and can be described as a modularized truss or a generally triangular truss 10. Truss 10 includes a base 12, an apex or peak 14 and heels 16.

Figure 18:
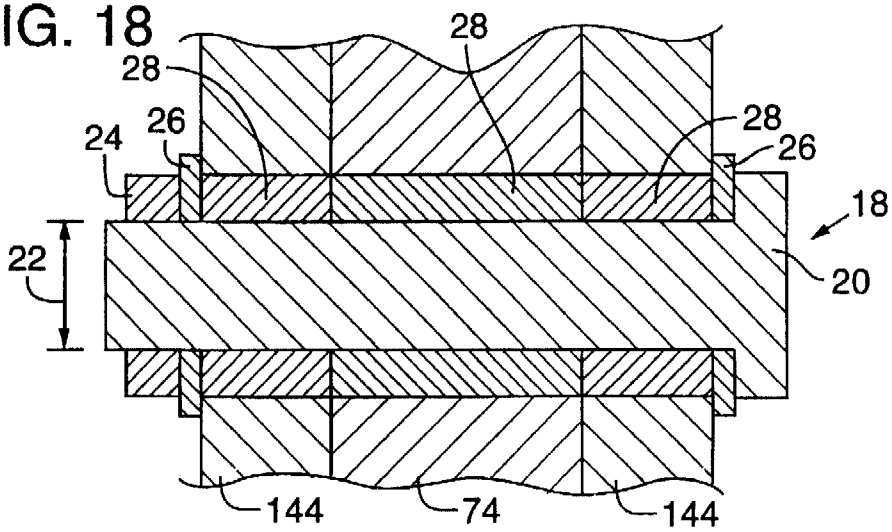
FIG. 18 is a cross-sectional elevation of one of the pinned joints shown in FIG. 1, shown on about half the scale as in FIG. 15.
Figure 15:
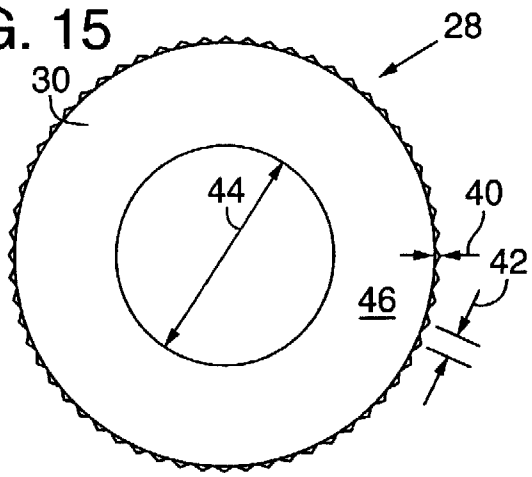
FIG. 15 is a from elevation of one of the sleeves of the truss shown in FIG. 1, shown on a much larger scale than in FIG. 1.

A pin 18 interconnects selected elements of truss 10. As shown best in FIG. 18, pin 18 is preferably a bolt 20 having a primary outer diameter 22. A nut 24 and washers 26 are threaded and slid onto bolt 20. The bolt and nut generally require the use of a tool to properly assemble a joint. However, it is also possible to use other types of pins, and toolless pins, not shown.

Figure 16:
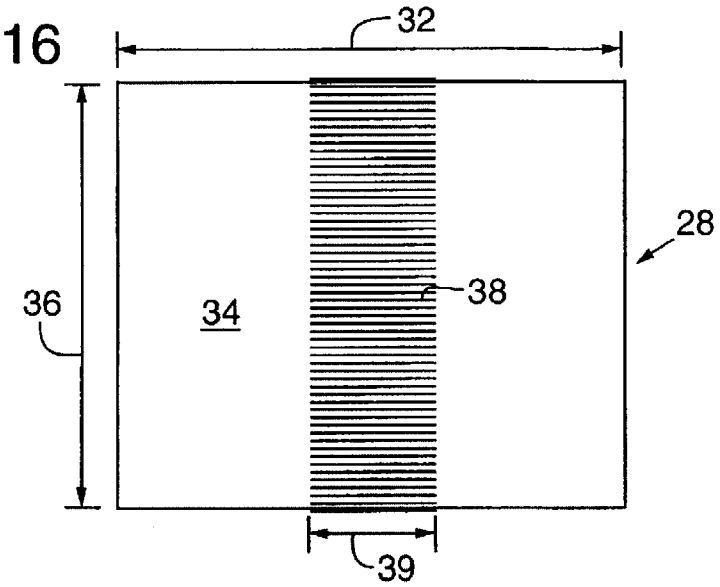
FIG. 16 is a top plan view of one of the longer of the sleeves shown in FIG. 1, shown on about the same scale as in FIG. 15.
Figure 17:
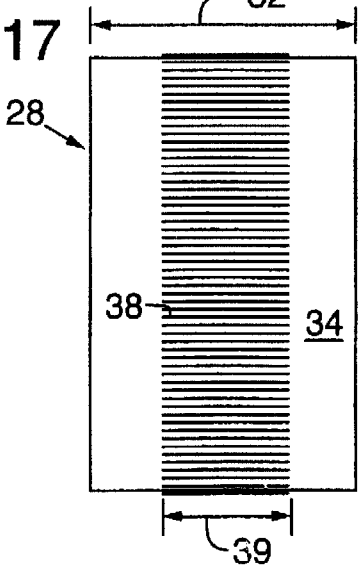
FIG. 17 is a top plan view of one of the shorter of the sleeves shown in FIG. 1, shown on about the same scale as in FIG. 15.

Various sizes of pins 18 can be used, with the primary outer diameter being larger or smaller as desired. In the preferred embodiment, a single size diameter of pin 18 is used, supplemented by a press-fit sleeve 28. Sleeve 28, shown in FIGS. 15–18, includes a cylindrical body 30 with a length 32 and an outer surface 34 defining a primary outer diameter 36. A band 38 is created in outer surface 34 in the form of a knurl having a plurality of ridges having a band length 39, each ridge having a peak height 40 and a ridge-to-ridge knurl spacing 42. The graphical representation of knurl 38 in FIGS. 16 and 17 is an approximation. The indicated ridges and valleys are shown evenly spaced, rather than distributed as if on a cylindrical body such as body 30. An inner diameter of body 30 is indicated at 44, and the ends or faces of body 30 are indicated at 46.

One of the truss elements is a horizontal element that forms the primary joist of truss 10, also referred to as a horizontal chord or bottom chord 48. Chord 48 has faces 50 (see FIG. 6) defining a width 52 and edges 54 (FIG. 7) defining a thickness 56. Chord 48 also has ends 58, each end 58 being formed with a bevel 60. A hole 62 is formed adjacent each end 58, with a diameter 64 sized to receive one of press-fit sleeves 28.

Bottom chord 48 has a body 66 with a center 68 that is intermediate ends 58. Holes 70, each having a diameter 72, are formed in body 66, and generally are intermediate ends 58 and center 68.

The top elements of truss 10 are the rafters, also referred to as inclined chords or top chords 74. Each top chord 74 has faces 76 (FIG. 8) defining a width 78, and edges 80 (FIG. 9) defining a thickness 82. One end of top chord 74 is referred to as upper end 84, and has formed therein a half joint 86 with a thickness 88 and a hole 90 with a diameter 92. Top chord 74 also includes a lower end or distal end 94 in which a hole 96 is formed with a diameter 98. Hole 96 is large enough to receive one of press-fit sleeves 28.

Top chord 74 further includes a body 100 in which an upper hole 102 is formed having a diameter 104, and a lower hole 106 is formed having a diameter 108. Diameter 104 of upper hole 102 is preferably large enough to receive one of press-fit sleeves 28.

Figure 12:
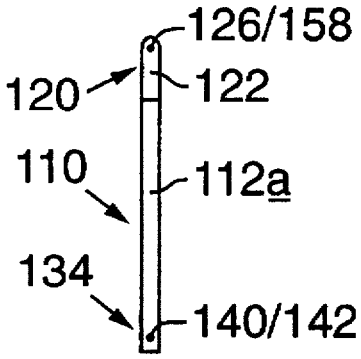
FIG. 12 is a front elevation of one of the vertical ties of the truss shown in FIG. 1, shown on about the same scale as in FIG. 1.
Figure 13:
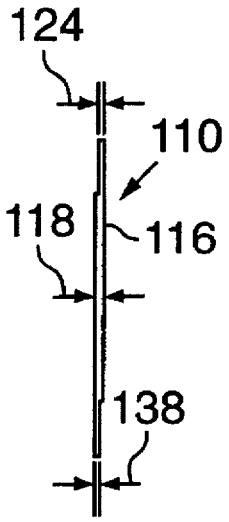
FIG. 13 is a right side elevation of the vertical tie shown in FIG. 12, shown on about the same scale as in FIG. 12.
Figure 14:
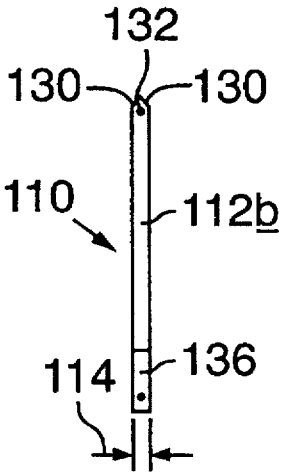
FIG. 14 is a rear elevation of the vertical tie shown in FIG. 12, shown on about the same scale as in FIG. 12.

The inner elements of truss 10 include studs or vertical ties 110, each having a face 112, with a first face indicated at 112a (FIG. 12) and second face indicated at 112b (FIG. 14). Face 112 defines a width 114 for tie 110. Each of the vertical ties 110 also includes edges 116 (FIG. 13) that define a thickness 118. An upper end of each tie 110 is indicated at 120 (FIG. 12), having a half joint 122 formed on first face 112a, with a thickness indicated at 124. A hole 126 is formed in upper end 120, with a diameter indicated at 128. A pair of bevels 130 (FIG. 14) is also formed in faces 112 of upper end 120 to define a point or apex 132.

Each vertical tie 110 has a lower end 134 having a half joint 136 formed on second face 112b, defining a thickness 138. A hole 140 having a diameter 142 is formed in lower end 134.

Figure 10:
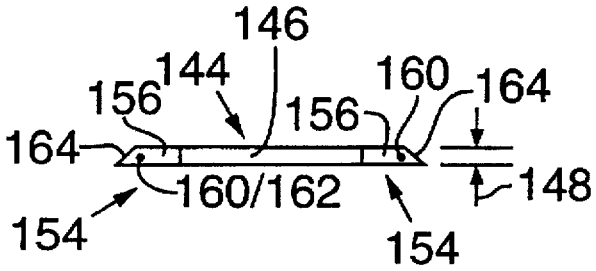
FIG. 10 is a front elevation of the rearward one of the collar ties of the truss shown in FIG. 1, shown on about the same scale as in FIG. 1, with the forward one of the collar ties in FIG. 1 being identical to the collar tie shown in FIG. 10, but simply turned around.
Figure 11:
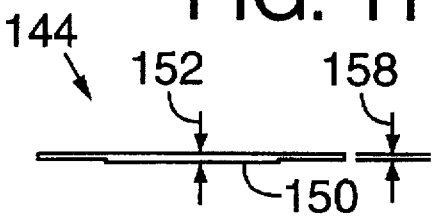
FIG. 11 is a top plan view of the collar tie shown in FIG. 10, shown on about the same scale as in FIG. 10.

Other inner elements of truss 10 include secondary joists in the form of a pair of horizontal ties or collar ties 144, with one of the pair being shown in FIGS. 10 and 11. Each collar tie 144 has a face 146 (FIG. 10) defining a width 148, and an edge 150 (FIG. 11) defining a thickness 152. Collar ties 144 each have ends 154, each having a half joint 156 defining a thickness 158. Half joints 156 are each formed in the same face 146 of each tie 144. Holes 160 defining a diameter 162 are formed in ends 154, and are preferably large enough to receive one of press-fit sleeves 28. A bevel 164 is formed in each end 154. It is possible that the pair of collar ties 144 are formed as a single member, but the preferred embodiment is in the form of a pair of members which are joined together at their ends.

When assembled, the above-identified elements, pins and sleeves define various joints, also referred to as pivoting connections, pivotal joints, bolted joints or pinned joints 166. Those joints created between two half joints are lap joints 168, such as between the two top chords 74, shown best in FIG. 1. Those joints formed between a half joint that is overlapped with another element without a half joint are referred to as lap/overlap joints 170, such as between chords 74 and ties 110 or 144. Finally, those joints formed between elements completely without half joints are referred to as overlap joints 172, such as between one of top chords 74 and bottom chord 48.

The selective use of lap, lap/overlap and overlap joints has been found to create a truss in which the applied forces are properly stabilized. The alignment of the elements also cooperates with the conventional spacing between trusses to allow easy installation of sheathing, insulation and other attached items. However, other configurations of such joints are envisioned within the scope of the present invention.

A living space or living area 174 is defined between bottom chord 48, vertical ties 110, top chords 74 and collar ties 144, with a floor 176 being defined by bottom chord 48, walls 178 being defined by vertical ties 110 and a ceiling 180 being defined by collar ties 144. A triangular storage space 182 is defined by bottom chord 48, top chorals 74 and vertical ties 110, and is generally located outwardly of living space 174.

The truss elements are pre-fabricated with the appropriate half joints, bevels, holes and inserted sleeves. They are preferably made out of laminated strand lumber (LSL), an engineered lumber in which strands of wood averaging about 8-inches in length are coated with adhesive, selectively aligned and then hot pressed and cut to form a finished board. A detailed description of this type of lumber is found in U.S. Pat. No. 4,751,131. LSL is available from Trus Joist MacMillan of Boise, Id., under the trademark Timberstrand®. LSL is preferred because it is very uniform in its dimensional and strength properties initially and over time. Thus, making the invented truss out of LSL takes full advantage of the available precision of factory formed elements. It has also been found that LSL is superior to conventional sawn lumber when used in structures with eccentrically loaded joints.

The following are the preferred dimensions for the truss elements, if made from Timberstrand® LSL, material grade 1.5E, for several truss spans. The lengths of the top chords, vertical ties and collar ties will vary depending on the desired slope of the roof. The listed ranges are for slopes of 10:12 and 12:12, but other slopes are possible.

| TRUSS ELEMENT | WIDTH (inches) | THICKNESS (inches) | LENGTH (feet) |
|---|---|---|---|
| | TWENTY-TWO FOOT SPAN | | |
| BOTTOM CHORD | 9.5 | 1.5 | 22.7 |
| TOP CHORD | 5.8 | 1.5 | 17.9 to 19.5 |
| VERTICAL TIE | 3.3 | 1.5 | 4.6 to 6.0 |
| COLLAR TIE | 3.3 | 1.5 | 5.7 to 6.0 |
| | TWENTY-FOUR FOOT SPAN | | |
| BOTTOM CHORD | 9.5 | 1.5 | 24.7 |
| TOP CHORD | 5.8 | 1.5 | 19.2 to 20.8 |
| VERTICAL TIE | 3.3 | 1.5 | 5.5 to 6.5 |
| COLLAR TIE | 3.3 | 1.5 | 6.8 to 7.0 |
| | TWENTY-SIX FOOT SPAN | | |
| BOTTOM CHORD | 11.9 | 1.5 | 26.7 |
| TOP CHORD | 6.5 | 1.5 | 20.5 to 22.3 |
| VERTICAL TIE | 3.3 | 1.5 | 5.8 to 6.9 |
| COLLAR TIE | 3.3 | 1.5 | 6.1 to 7.9 |
| | TWENTY-EIGHT FOOT SPAN | | |
| BOTTOM CHORD | 11.9 | 1.5 | 28.7 |
| TOP CHORD | 6.5 | 1.5 | 21.8 to 23.7 |
| VERTICAL TIE | 3.3 | 1.5 | 6.2 to 7.4 |
| COLLAR TIE | 3.3 | 1.5 | 6.7 to 8.0 |

The half joints for all of the above element sizes are about half of the thickness of the element, or 0.75-inches. The pins are preferably bolts with an outer diameter of 0.75-inches, with a length of 2.75 to 4.5-inches. The sleeves are 1.25-inches in outer diameter, 0.75-inches in inner diameter, and are either 0.75-inches or 1.5-inches in length, to match the thickness of the truss elements and half joints. Each sleeve has a texture over a band of about 0.375-inches in length, centrally located, with a ridge height of about 0.01-inches, so that the outer diameter of the texture is about 1.27-inches.

Figure 29:
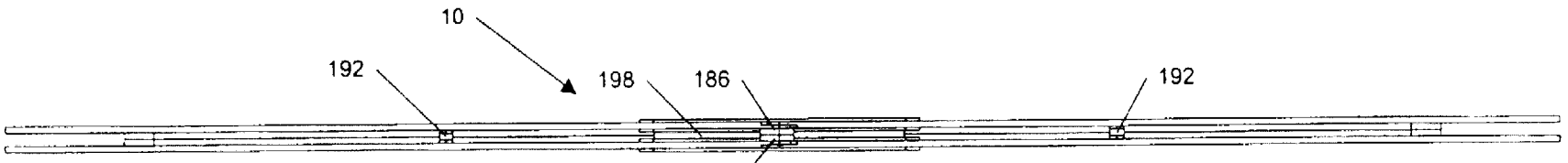
FIG. 29 is a top plan view of the double truss shown in FIG. 28, shown on about the same scale as in FIG. 28.
Figure 30:
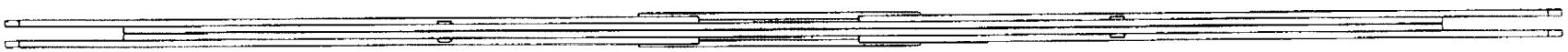
FIG. 30 is a bottom plan view of the double truss shown in FIG. 28, shown on about the same scale as in FIG. 28.

For the above-specified dimensions of elements, it has been found that two trusses 10 can be assembled into a double truss, for use carrying larger loads, such as when larger on center truss spacings are desired. In a double truss, a plurality of spacers 184, shown in detail in FIGS. 19–27, are interposed two trusses 10, with trusses 10 being front-to-front, and pins 18 extending through the elements of both trusses 10 and spacers 184. A front or rear view of the double truss would thus be identical to the view of truss 10 in FIG. 1, and the other views are as shown in FIGS. 28–30.

Spacers 184 include a pair of ridge blocks 186, each having a hole 188 with a diameter 190, a pair of vertical blocks 192, each having a hole 194 with a diameter 196, and a collar block 198, having a hole 200 with a diameter 202. Diameters 190, 196 and 202 are each preferably about 0.75-inches. As an alternative to spacers 184 being blocks 186, 192 and 198, they can be sleeves (not shown) similar to sleeves 28, but with an outer diameter generally larger (i.e. about 1.5-inches to 2-inches) than outer diameter 36.

Given the above identification of the various elements of truss 10, numerous combinations and subcombinations of these elements are within the scope of this invention. Thus, the embodiments can be described in many ways. For example, one embodiment includes a generally triangular truss 10 with a horizontal chord 48 and a pair of inclined chords. Inclined chords 74 are joined at an apex 14, and horizontal chord 48 extends between inclined chords 74 to form a base 12 of generally triangular truss 10. A pair of vertical ties 110 extends between inclined chords 74 and horizontal chord 48, and a horizontal tie 144 extends between inclined chords 74. Chords 48 and 74 and ties 110 and 144 define therebetween a space 174 in which to construct a living area.

Chords 48 and 74 and ties 110 and 144 are formed of engineered lumber and the joints between chords 48 and 74 and ties 110 and 144 are defined by holes extending through the chords and ties, with pins 18 extending through adjacent ones of the holes to create a pivoting pinned joint 166.

Selected ones of joints 166 are reinforced with press-fit sleeves 28 that are inserted into a predrilled hole in the respective truss element. Sleeves 28 are designed so that the outer diameter 36 of the body 30 of sleeve 28 is significantly larger than the pin for all of joints 166. The outer surface 34 of body 30 is smooth except for a central band 38 that is knurled to create a slightly raised texture. The knurl creates an interference fit with the element into which it is inserted, yet does not damage the structural integrity of that element.

To assemble truss 10, the top chords 74 are pivotally connected at one end 84 by a corner lap joint, pinned by a bolt 20 and nut 24. Distal ends 94 of chords 74 are then structurally interconnected by bottom chord 48, with bottom chord 48 overlapping top chords 74. A pivotal joint is formed between bottom chord 48 and each top chord 74, and is reinforced with a press-fit sleeve 28 inserted into each of top chords 74 and each end of bottom chord 48.

Vertical ties 110 then structurally interconnect an intermediate portion 66 of bottom chord 48 to an intermediate portion 100 of each top chord 74. Each vertical tie 110 has ends 120 and 134 that are formed with a half joint 122 and 136, with one end 120 having a half joint 122 on one face **112*a* of tie 110, and the other end 134 having a half joint 136 on the opposite face 112*b*. Each tie 110 is then pivotally joined to both one of top chords 74 and bottom chord 48. Furthermore, upper end 120 of each vertical tie 110 is bevelled at a 45° angle on both edges so that, when vertical tie 110 is lapped/overlapped on its respective top chord 74, vertical tie 110 does not protrude above top chord 74. By bevelling both edges, each vertical tie 110 can be used either on the left or right side of truss 10**.

Finally, each end 154 of each collar tie 144 is formed with a half joint 156, with each half joint being on the same face 146 of collar tie 144. Collar ties 144 are then each attached to both of top chords 74 so that each top chord 74 is sandwiched between half joints 156 of collar ties 144. A pivoting connection is formed by the combination of a press-fit sleeve 28 inserted into each top chord 74 and each end of each collar tie 144, with a bolt 20 and nut 24 extended through the appropriate sleeves.

The pinned construction, including the use of press-fitted sleeves 28, is found to result in a very effective joint in engineered lumber that is superior to conventional nailed joints. The combination of the bolt-washer-sleeve-sleeve-washer-nut of the preferred pin provides an effective connector to resist eccentric joint loads. It also allows the components of truss 10 to be shipped unassembled, which is significantly simpler than shipping a conventional, pre-manufactured truss. For example, the preferred embodiment only requires a shipping space of about 29-feet by 1-foot by 5-inches for each single truss. A conventional press-plated truss of the same size would be shipped preassembled, requiring a shipping space of about 32-feet by 14-feet by 2-inches.

Each piece of truss 10 is relatively light, and thus easy for a worker to hand-carry. This allows truss 10 to be assembled at a convenient location on the job site, and then lifted into place. Alternatively, each piece could be assembled in place on the structure, eliminating the need for cranes or other complicated and expensive machinery.

The use of press-fitted sleeves 28 allows the entire truss 10 to be assembled with only a single diameter pin 18. This simplifies on-site assembly. Similarly, the use of half joints means that only three lengths of pins 18 are necessary for each joint to be clean, with minimal pin overhang. Alternatively, a single length of pin could be used, with excess overhang only for the peak and vertical tie joints. This would further simplify on-site construction of the truss at a minimal expense, both in cost and appearance.

For all of the above reasons, the pinned construction allows for quick and simple on-site assembly of truss 10, and creates a durable structure that has both a usable living space 174 and matched workable storage spaces 182, with no additional structural members extending into any of these spaces. Thus, truss 10 is far superior to a conventional truss for the same span and living space requirements.

Described differently, truss 10 includes truss elements formed of engineered lumber and selectively interconnected by pinned joints 166. Each joint 166 is created between to-be-joined truss elements by extending pin 18 through all of the to-be-joined truss elements at that joint.

One of the truss elements is a bottom chord 48 including ends 58 and a body 66 intermediate ends 58. Another is a first top chord 74 having an upper end 84, a lower end 94 distal from upper end 84, and a body 66, intermediate upper and lower ends 84 and 94. Another is a second top chord 74 similar to the first top chord 74. The truss elements also include a first vertical tie 110 having opposite ends 120 and 134, a second vertical tie 110 having opposite ends 120 and 134, and a collar tie 144 having opposite ends 154.

Upper end 84 of the first top chord 74 is joined to upper end 84 of the second top chord 74 by a first one of pins 18. Bottom chord 48 is joined to lower end 94 of the first top chord 74 by second one of pins 18, and joined to lower end 94 of the second top chord 74 by a third one of pins 18 so that the top chords 74 and bottom chord 48 together define a triangle. The first vertical tie 110 is joined to body 66 of bottom chord 48 by a fourth one of pins 18, and joined to body 100 of the first top chord 74 by a fifth one of pins 18, with the first vertical tie 110 extending about perpendicular to bottom chord 48. The second vertical tie 110 is joined to body 66 of bottom chord 48 by a sixth one of pins 18, and joined to body 100 of the second top chord 74 by a seventh one of pins 18, with the second vertical tie 110 extending about perpendicular to bottom chord 48. Collar tie 144 is joined to body 100 of the first top chord 74 by an eighth one of pins 18, and joined to body 100 of the second top chord 74 by a ninth one of pins 18, with collar tie 144 extending about parallel to bottom chord 48.

Preferably a sleeve 28 having an inner diameter 44 that is about the same as diameter 22 of one of pins 18, and an outer diameter 36 that is significantly greater than diameter 22 of that one of pins 18 is extended through a selected truss element. One of pins 18 is then extended through both sleeve 28 and a selected second truss element. For example, a sleeve 28 is inserted into bottom chord 48, top chords 74, and collar tie 144. Thus, a sleeve is inserted into those truss elements that extend substantially parallel to bottom chord 48.

Sleeve 28 has outer surface 34 defined by outer diameter 36, with texture 38 formed thereon. Texture 38 has a plurality of ridges that extend outwardly from outer surface 34 to define height 40 of texture 38. The ratio of height 40 to outer diameter 36 is about 1-to-125. The ridges are spaced about uniformly by a texture ridge spacing 42, and the ratio of texture ridge spacing 42 to outer diameter 36 is about 1-to-20. Sleeve 28 has a length 32 defined by outer surface 34 and texture 38 defines a band having a length 39 measured parallel to length 32. The ratio of length 39 to length 32 ranges from about 1-to-4 to 1-to-2.

Alternatively, several size pins 18 could be used, with the diameter 22 of a first one of the pins 18 is significantly greater than the diameter 22 of a second one of the pins 18. A first one of the truss elements is joined to a second one of the truss elements by extending the first pin 18 through both the first truss element and the second truss element and a third one of the truss elements is joined to the second truss element by extending the second pin 18 through both the third truss element and the second truss element. Each truss element has a face, defining the width of the truss element and the pins generally extend through the faces of the truss elements. The ratio of the diameter of any one of the pins to the width of each of the truss elements ranges from about 1-to-2 to 1-to-16.

In one version of this embodiment, the first truss element is bottom chord 48, the second truss element is one of the top chords 74 and the third truss element is the other one of top chords 74. Bottom chord 48 can also be joined to the third truss element by extending a third pin with a diameter of the second pin through both bottom chord 48 and the third truss element.

In another version, the first truss element is collar tie 144, the second truss element is one of top chords 74 and the third truss element is the other one of top chords 74.

In these embodiments, the first truss element extends substantially parallel to bottom chord 48 and the second and third truss elements extend substantially nonparallel to bottom chord 48.

The above embodiments can be differently defined, with each top chord 74 having upper end 84, a half joint 86 formed in each vertical tie also has a first face **112*a* in which a first half joint 122 is formed and a second face 112*b* opposite first face 112*a* in which a second half joint 136** is formed.

Figures 1, 2, 3, 4:
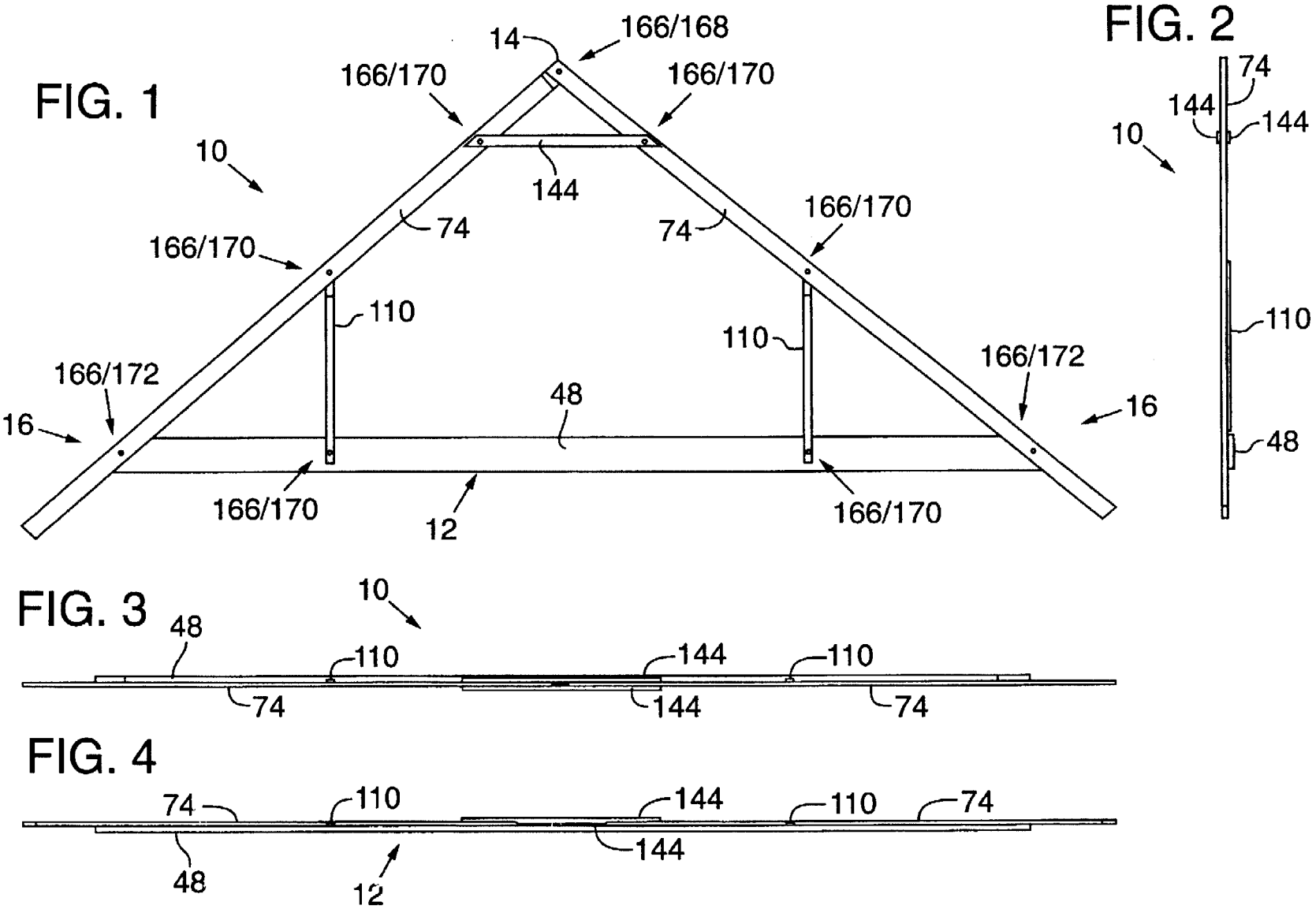
FIG. 1 is a front elevation of the truss of the preferred embodiment of the present invention.
FIG. 2 is a right side elevation of the truss shown in FIG. 1, shown on about the same scale as in FIG. 1, with the left side elevation being a mirror image of FIG. 2.
FIG. 3 is a top plan view of the truss shown in FIG. 1, shown on about the same scale as in FIG. 1.
FIG. 4 is a bottom plan view of the truss shown in FIG. 1, shown on about the same scale as in FIG. 1.
Figures 5, 6, 7, 8, 9:
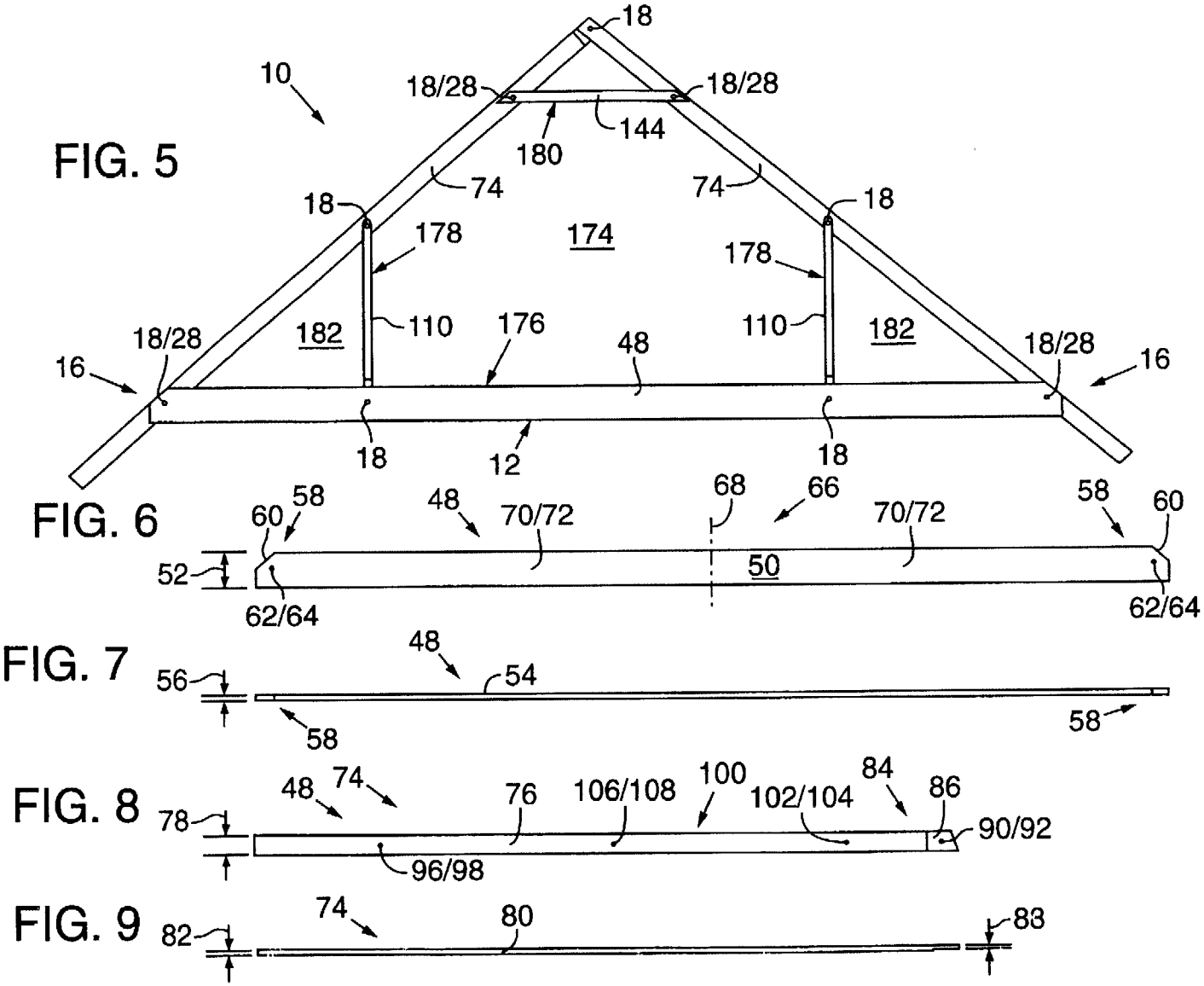
FIG. 5 is a rear elevation of the truss shown in FIG. 1, shown on about the same scale as in FIG. 1.
FIG. 6 is a front elevation of the bottom chord of the truss shown in FIG. 1, shown on about the same scale as in FIG. 1.
FIG. 7 is a top plan view of the bottom chord shown in FIG. 6, shown on about the same scale as in FIG. 6.
FIG. 8 is a front elevation of the left one of the top chords of the truss shown in FIG. 1, shown on about the same scale as in FIG. 1, with the right one of the top chords in FIG. 1 being identical to the top chord shown in FIG. 8, but simply turned around.
FIG. 9 is a top plan view of the top chord shown in FIG. 8, shown on about the same scale as in FIG. 8.

Thus, the elements can be assembled so top chords 74 are coplanar and bottom chord 48 lies in a plane that is parallel to but not coplanar with top chords 74, as shown in FIGS. 2–4. Similarly, vertical ties 110 can be coplanar, lie in a plane that is parallel to but not coplanar with top chords 74, and be intermediate top chords 74 and bottom chord 48.

Furthermore, a second collar tie 144 can be joined to top chords 74 so that first collar tie 144 and second collar tie 144 sandwich each top chord 74 therebetween.

This can be still further defined so that each collar tie 144 has a face 146 in which a half joint 156 is formed at each of its opposite ends 154 and collar ties 144 are joined to top chords 74 so that the defined face 146 of the first collar tie is immediately adjacent the defined face 146 of the second collar tie.

Finally, a method of assembling a truss is also provided herein. The steps comprise: providing a plurality of truss elements formed of engineered lumber, each truss element cut to a predefined length, width, thickness and configuration that need not be the same as the length, width, thickness or configuration of any other truss element, with the thickness of each truss element being a significant portion of the width of that truss element; providing a plurality of pins 18, each pin 18 having a diameter 22 that is about the same as the diameter of about all of the other pins, and that is a significant portion of the width of each truss element; providing a sleeve 28 having an inner diameter 44 that is about the same as diameter 22, and an outer diameter 36 that is significantly greater than diameter 22; forming one or more holes in each of the truss elements, each hole having a diameter that is a significant portion of the width of the truss element in which the hole is formed, with at least one of the holes being a pin-receiving hole having a diameter that is about equal to diameter 22, and another of the holes being a sleeve-receiving hole having a diameter that is about equal to diameter 36; inserting sleeve 28 into the sleeve-receiving hole; and joining one or more of the truss elements to each other by extending a pin 18 through one or more of the pin-receiving holes, and by extending a pin through the sleeve.

Modifications to the preferred embodiment can be made without departing from the scope of the present invention. These modifications are intended to be encompassed by the following claims.

We claim:

1. A generally triangular truss, comprising:

a horizontal chord and a pair of inclined chords, the inclined chords being joined at an apex, and the horizontal chord extending between the inclined chords to form a base of the generally triangular truss;

a pair of vertical ties, each of which extends upwardly from the horizontal chord and interconnecting with the inclined chords, and a horizontal tie extending between the two inclined chords at points spaced substantially above the interconnection between the vertical ties and the inclined chords, the chords and ties defining therebetween a space in which to construct a living area; and a plurality of pins;

wherein:

the chords are formed of engineered lumber; and the joints between the chords and ties are defined by holes extending through the chords and ties, with the pins extending through adjacent ones of the holes to create pinned joints.

2. A truss for attachment to a structure, the truss comprising:

a plurality of pins, each pin having a diameter; and a plurality of truss elements formed of engineered lumber;

wherein:

the truss elements are interconnected by pinned joints, each joint created between truss elements by extending one of the pins through all of the truss elements at that joint;

one of the truss elements is a bottom chord including ends and a body intermediate the ends;

one of the truss elements is a first top chord having an upper end, a lower end distal from the upper end, and a body intermediate the upper and lower ends;

one of the truss elements is a second top chord having an upper end, a lower end distal from the upper end, and a body intermediate the upper and lower ends;

one of the truss elements is a first vertical tie having opposite ends;

one of the truss elements is a second vertical tie having opposite ends;

one of the truss elements is a collar tie having opposite ends;

the upper end of the first top chord is joined to the upper end of the second top chord by one of the pins;

the bottom chord is joined to the lower end of the first top chord by one of the pins, and joined to the lower end of the second top chord by one of the pins, with at least a substantial portion of the body of the bottom chord extending between the top chords, so that the top chords and bottom chord together define a triangle;

the first vertical tie is joined to the body of the bottom chord by one of the pins, and joined to the body of the first top chord by one of the pins, with the first vertical tie extending substantially perpendicular to the bottom chord;

the second vertical tie is joined to the body of the bottom chord by one of the pins, and joined to the body of the second top chord by one of the pins, with the second vertical tie extending substantially perpendicular to the bottom chord; and the collar tie is joined to the body of the first top chord by one of the pins, and joined to the body of the second top chord by one of the pins, with the collar tie extending substantially parallel to the bottom chord, with the joints between the collar tie and the top chords being spaced substantially above the joints between the vertical ties and the top chords.

3. The truss according to claim 2, further comprising a sleeve having an inner diameter that is substantially the same as the diameter of one of the pins, and an outer diameter that is significantly greater than the diameter of that one of the pins;

wherein a first one of the truss elements is joined to a second one of the truss elements by extending the sleeve through the first truss element, and by extending a pin through both the sleeve and the second truss element.

4. The truss according to claim 3, wherein the first truss element is the bottom chord, and the second truss element is one of the top chords.

5. The truss according to claim 3, wherein the first truss element is the collar tie, and the second truss element is one of the top chords.

6. The truss according to claim 5, further comprising a second sleeve having an inner diameter that is substantially the same as the diameter of another one of the pins, and an outer diameter that is significantly greater than the diameter of that one of the pins;

wherein the bottom chord is joined to the second truss element by extending the second sleeve through the bottom chord, and by extending a pin through both the second sleeve and the second truss element.

7. The truss according to claim 3, wherein the first truss element extends substantially parallel to the bottom chord.

8. The truss according to claim 3, wherein the sleeve has an outer surface defined by the outer diameter of the sleeve, and the outer surface has formed thereon a texture.

9. The truss according to claim 8, wherein the texture has a plurality of ridges that extend outwardly from the outer surface to define a height of the texture.

10. The truss according to claim 9, wherein the ratio of the height of the texture to the outer diameter of the sleeve is approximately 1-to-125.

11. The truss according to claim 9, wherein the ridges are spaced substantially uniformly by a texture ridge spacing, and the ratio of the texture ridge spacing to the outer diameter of the sleeve is approximately 1-to-20.

12. The truss according to claim 8, wherein:

the sleeve has a length defined by the outer surface of the sleeve;

the texture defines a band having a length measured parallel to the length of the sleeve; and the ratio of the length of the band to the length of the sleeve ranges from approximately 1-to-4 to 1-to-2.

13. The truss according to claim 3, wherein the diameter of each pin is approximately 0.75-inches and each truss element has a width that ranges from approximately 3-inches to 12-inches.

14. The truss according to claim 13, wherein the outer diameter of each sleeve is approximately 1.25-inches.

15. The truss according to claim 2, wherein:

each pin has a diameter;

each truss element has a face defining the width of the truss element;

the pins generally extend through the faces of the truss elements; and the ratio of the diameter of any one of the pins to the width of each of the truss elements ranges from approximately 1-to-2 to 1-to-16.

16. The truss according to claim 2, wherein:

the diameter of a first one of the pins is significantly greater than the diameter of a second one of the pins;

a first one of the truss elements is joined to a second one of the truss elements by extending the first pin through both the first truss element and the second truss element; and a third one of the truss elements is joined to the second truss element by extending the second pin through both the third truss element and the second truss element.

17. The truss according to claim 16, wherein:

the first truss element is the bottom chord;

the second truss element is one of the top chords; and the third truss element is the other one of the top chords.

18. The truss according to claim 17, wherein:

the diameter of a third one of the pins is significantly greater than the diameter of the second pin;

the bottom chord is joined to the third truss element by extending the third pin through both the bottom chord and the third truss element.

19. The truss according to claim 16, wherein:

the first truss element is the collar tie;

the second truss element is one of the top chords; and the third truss element is the other one of the top chords.

20. The truss according to claim 19, wherein:

the diameter of a third one of the pins is significantly greater than the diameter of the second pin;

the bottom chord is joined to the second truss element by extending the third pin through both the bottom chord and the second truss element.

21. The truss according to claim 16, wherein:

the first truss element extends substantially parallel to the bottom chord;

the second truss element extends substantially nonparallel to the bottom chord; and the third truss element extends substantially nonparallel to the bottom chord.

22. A truss for attachment to a structure, the truss comprising:

a plurality of pins, each pin having a diameter;

a bottom chord including ends and a body intermediate the ends;

a first top chord and a second top chord, each top chord having an upper end, a lower end distal from the upper end, and a body intermediate the upper and lower ends;

a first vertical tie and a second vertical tie, each vertical tie having opposite ends, a first face at one of the opposite ends and a second face opposite the first face at the other opposite end; and a collar tie having opposite ends;

wherein:

the upper ends of the top chords are joined to each other by one of the pins;

one of the ends of the bottom chord is joined to the lower end of one of the top chords by one of the pins, and the other of the ends of the bottom chord is joined to the lower end of the other of the top chords by one of the pins;

one of the ends of one of the vertical ties is joined to the body of the bottom chord by one of the pins, and the other end of that vertical tie is joined to the body of one of the top chords by one of the pins;

one of the ends of the other of the vertical ties is joined to the body of the bottom chord by one of the pins, and the other end of that vertical tie is joined to the body of the other of the top chords by one of the pins; and one of the ends of the collar tie is joined to the body of one of the top chords by one of the pins, and the other end of each collar tie is joined to the body of the other of the top chords by one of the pins, with the collar tie being spaced substantially from the interconnection between the vertical ties and the top chords.

23. The truss according to claim 22, wherein:

the top chords are coplanar; and the bottom chord lies in a plane that is parallel to but not coplanar with the top chords.

24. The truss according to claim 23, wherein the vertical ties are coplanar, lie in a plane that is parallel to but not coplanar with the top chords, and are intermediate the top chords and the bottom chord.

25. The truss according to claim 24, wherein:

each vertical tie has a top, opposed edges and opposed faces;

the faces define a width and the edges define a thickness that is substantially less than the width; and the faces are symmetrically beveled adjacent the top to define an apex so that a given vertical tie can be attached to either one of the top chords.

26. The truss according to claim 22, further comprising a second collar tie having opposite ends, wherein one of the ends of one of the second collar tie is joined to the body of one of the top chords by one of the pins, the other end of the second collar tie is joined to the body of the other of the top chords by one of the pins, and the first collar tie and the second collar tie sandwich each top chord therebetween.

27. The truss according to claim 26, wherein:

the first collar tie has a face at each of the opposite ends;

the second collar tie has a face at each of the opposite ends; and the collar ties are joined to the top chords so that the face of the first collar tie is immediately adjacent the face of the second collar tie.

28. A method of assembling a truss, comprising the steps of:

providing a plurality of truss elements formed of engineered lumber;

providing a plurality of pins;

providing a sleeve having an inner diameter that is substantially the same as that of one of the pins having the same diameter;

forming one or more holes in each of the truss elements, with at least one of the holes being a sleeve-receiving hole having a diameter that is substantially equal to the outer diameter of the sleeve;

inserting the sleeve into the sleeve-receiving hole; and joining the plurality of truss elements to each other, at least two of the truss elements being joined by extending through the sleeve, the pin having substantially the same diameter as the sleeve;

wherein the truss elements include:

a horizontal chord and a pair of inclined chords, the inclined chords being joined at an apex, and the horizontal chord extending between the inclined chords to form a base of the generally triangular truss;

a pair of vertical ties, each of which extends upwardly from the horizontal chord and interconnects with the inclined chords; and a horizontal tie extending between the two inclined chords at points spaced from the interconnection between the vertical ties and the inclined chords, the truss elements defining therebetween a space in which to construct a living area.

29. The method according to claim 28, wherein the sleeve has an outer surface defined by the outer diameter of the sleeve, and the outer surface has formed thereon a texture.

30. The method according to claim 29, wherein the texture has a plurality of ridges that extend outwardly from the outer surface to define a height of the texture.

31. The method according to claim 30, wherein the ratio of the height of the texture to the outer diameter of the sleeve is approximately 1-to-125.

32. The method according to claim 30, wherein the ridges are spaced substantially uniformly by a texture ridge spacing, and the ratio of the texture ridge spacing to the outer diameter of the sleeve is approximately 1-to-20.

33. The method according to claim 29, wherein:

the sleeve has a length defined by the outer surface of the sleeve;

the texture defines a band having a length measured parallel to the length of the sleeve; and the ratio of the length of the band to the length of the sleeve ranges from approximately 1-to-4 to 1-to-2.

34. The method of claim 28, wherein at least two of the trusses include holes which are pin-receiving holes having diameters that are substantially equal to the diameter of one of the pins, and wherein at least those two truss elements are joined together by inserting a pin through the pin-receiving holes.

* * * * *